US009375938B2

(12) United States Patent
Kondo et al.

(10) Patent No.: US 9,375,938 B2
(45) Date of Patent: Jun. 28, 2016

(54) INK CARTRIDGE AND INK JET PRINTING APPARATUS

(71) Applicant: CANON KABUSHIKI KAISHA, Tokyo (JP)

(72) Inventors: Soji Kondo, Yokohama (JP); Yasuo Kotaki, Yokohama (JP); Kenta Udagawa, Tokyo (JP); Naozumi Nabeshima, Tokyo (JP); Tatsuo Nanjo, Kawasaki (JP); Kazuya Yoshii, Yokohama (JP)

(73) Assignee: CANON KABUSHIKI KAISHA, Yokyo (JP)

( * ) Notice: Subject to any disclaimer, the term of this patent is extended or adjusted under 35 U.S.C. 154(b) by 0 days.

(21) Appl. No.: 14/744,939

(22) Filed: Jun. 19, 2015

(65) Prior Publication Data

US 2015/0375512 A1 Dec. 31, 2015

(30) Foreign Application Priority Data

Jun. 27, 2014 (JP) ..... 2014-132857
Mar. 25, 2015 (JP) ..... 2015-063169
May 28, 2015 (JP) ..... 2015-108880

(51) Int. Cl.
*B41J 2/015* (2006.01)
*B41J 2/17* (2006.01)
*B41J 2/175* (2006.01)

(52) U.S. Cl.
CPC ..... *B41J 2/1752* (2013.01)

(58) Field of Classification Search
None
See application file for complete search history.

(56) References Cited

U.S. PATENT DOCUMENTS

| | | | | |
|---|---|---|---|---|
| 5,425,478 | A | 6/1995 | Kotaki et al. | 222/501 |
| 5,583,549 | A | 12/1996 | Ujita et al. | 347/86 |
| 5,619,237 | A | 4/1997 | Inoue et al. | 347/86 |
| 6,116,722 | A | 9/2000 | Sato et al. | 347/85 |
| 6,702,427 | B2 | 3/2004 | Shimizu et al. | 347/50 |
| 6,971,741 | B2 | 12/2005 | Nanjo et al. | 347/85 |
| 7,077,514 | B2 | 7/2006 | Inoue et al. | 347/86 |
| 7,104,640 | B2 | 9/2006 | Ogura et al. | 347/86 |

(Continued)

FOREIGN PATENT DOCUMENTS

| | | |
|---|---|---|
| JP | 2005-007855 | 1/2005 |
| JP | 2006-102971 | 4/2006 |

OTHER PUBLICATIONS

U.S. Appl. No. 14/744,926, filed Jun. 19, 2015.

(Continued)

*Primary Examiner* — Erica Lin
(74) *Attorney, Agent, or Firm* — Fitzpatrick, Cella, Harper & Scinto

(57) ABSTRACT

The ink cartridge has a communication unit for allowing an ink storage chamber to communicate with a space outside a housing. The communication unit includes a communication port formed on an outside surface of the housing, a merging channel having an end which communicates with the communication port, and a plurality of branch channels, each having an end which communicates with the merging channel and the other end which communicates with the ink storage chamber. In the branch channel, while ink flows backward, the ink flowing from the merging channel branches into the first branch channel and the second branch channel. At the same time, a ratio (Q1/Q2) between an ink flow rate in the first branch channel and an ink flow rate in the second branch channel while the ink is supplied is smaller than that while the ink flows backward.

15 Claims, 13 Drawing Sheets

(56) References Cited

U.S. PATENT DOCUMENTS

| | | | | |
|---|---|---|---|---|
| 7,854,499 | B2 | 12/2010 | Udagawa et al. | 347/86 |
| 7,950,790 | B2 | 5/2011 | Kubo et al. | 347/86 |
| 8,087,762 | B2 | 1/2012 | Takemura et al. | 347/85 |
| 8,205,974 | B2 | 6/2012 | Ogura et al. | 347/86 |
| 8,313,185 | B2 | 11/2012 | Hatasa et al. | 347/92 |
| 8,469,498 | B2 | 6/2013 | Ohashi et al. | 347/86 |
| 8,770,730 | B2 | 7/2014 | Nanjo et al. | 347/86 |
| 8,770,731 | B2 | 7/2014 | Miyashita et al. | 347/86 |
| 2004/0160496 | A1 | 8/2004 | Tsurui et al. | 347/86 |
| 2013/0222491 | A1* | 8/2013 | Nanjo et al. | B41J 2/17509 347/86 |

OTHER PUBLICATIONS

U.S. Appl. No. 14/744,973, filed Jun. 19, 2015.

* cited by examiner

INK CARTRIDGE AND INK JET PRINTING APPARATUS

BACKGROUND OF THE INVENTION

1. Field of the Invention

The present invention relates to an ink cartridge that can store ink and an ink jet printing apparatus for performing printing on a print medium by using ink supplied from the ink cartridge.

2. Description of the Related Art

Ink using pigments as a colorant is commercially used in ink jet print heads. The pigments, however, are based on dispersion, which are different from dyes which are based on dissolution, and therefore it is known that pigment particles precipitate in an ink cartridge in which ink is stored.

More specifically, if an ink cartridge is left for a long period of time while being mounted on an ink jet printing apparatus, precipitation of pigment particles occurs in ink stored in the ink cartridge. This causes a concentration gradient of pigment particles in the ink stored in the ink cartridge from its bottom toward its top. As a result, at the bottom of the ink cartridge, a concentration of pigment particles is high and an excessively highly colored layer is formed, whereas at the top of the ink cartridge, a concentration of pigment particles is low and an excessively lightly colored layer is formed.

A description will be given of the case where the ink cartridge is stored in a fixed position (in a state in which its bottom faces down in a vertical direction) for a long period of time in the configuration in which ink is delivered from the bottom of the ink cartridge. If the ink delivered from the bottom of the ink cartridge is supplied to a print head, ink forming a layer of a high concentration of pigment particles is supplied first, resulting in printing an excessively highly colored image. In other words, density variations which are visually recognized may be generated between a print image formed at an early stage of use of the ink cartridge and a print image formed at a later stage of use of the ink cartridge. Such a phenomenon is particularly conspicuous in color printing in which a color image is printed utilizing gradations of color.

A method for solving the above problem is disclosed in Japanese Patent Laid-Open No. 2005-007855, in which a connection portion for delivering ink in an ink cartridge is provided at the bottom of the ink cartridge, and a tube extending upwardly in a vertical direction is provided in the connection portion. The tube is provided with a plurality of ink inflow ports which communicate with the ink cartridge in their respective positions in the vertical direction, and the ink inflow port located at a lower part in the vertical direction has a greater inflow resistance as compared to the other ink inflow ports.

This allows the ink to flow into the tube from a position in which a concentration of pigment particles is high and a position in which a concentration of pigment particles is low in the ink cartridge in amounts corresponding to their respective inflow resistances, and the ink mixed in the tube is delivered from a delivery port formed at a lower end of the tube.

Furthermore, Japanese Patent Laid-Open No. 2006-102971 discloses a liquid injection apparatus having another technique to solve density variations generated between an image formed at an early stage of use of the cartridge and an image formed at a later stage of use of the cartridge. The liquid injection apparatus disclosed in Japanese Patent Laid-Open No. 2006-102971 is intended for uniformity of ink concentration in the cartridge by drawing liquid in a liquid reservoir space into a circulation channel and returning the liquid from the circulation channel to the liquid reservoir space to stir the liquid.

SUMMARY OF THE INVENTION

In a first aspect of the present invention, there is provided an ink cartridge comprising: a housing in which an ink storage chamber for storing ink is formed; and a communication unit configured to allow the ink storage chamber to communicate with a space outside the housing, wherein the communication unit includes a communication port formed on an outside surface of the housing, a merging channel having an end which communicates with the communication port, and a branch channel having an end which communicates with the merging channel and the other end which communicates with the ink storage chamber, wherein the branch channel includes at least one first branch channel communicating with a lower layer area in the ink storage chamber and at least one second branch channel communicating with an upper layer area located higher than the lower layer area in a gravity direction, wherein while ink is supplied to flow from the ink storage chamber to the outside, the ink flowing from the first branch channel and the second branch channel merges into the merging channel, and wherein in a case where an ink flow rate in the first branch channel is represented by Q1 and an ink flow rate in the second branch channel is represented by Q2, a ratio (Q1/Q2) between the ink flow rate in the first branch channel and the ink flow rate in the second branch channel while the ink is supplied is smaller than that while the ink flows backward to flow from the outside to the ink storage chamber.

In a second aspect of the present invention, there is provided an ink jet printing apparatus for supplying ink from an ink delivery unit to a print head and performing printing on a print medium by ejecting ink from the print head, the ink delivery unit comprising: an ink cartridge for storing ink to be supplied to a print head; an ink delivery unit capable of delivering ink between the ink cartridge and the print head; and an ink backflow unit configured to cause ink to flow backward from the ink delivery unit to the ink cartridge, the ink cartridge comprising: a housing in which an ink storage chamber for storing ink is formed; and a communication unit for allowing the ink delivery unit to communicate with the ink storage chamber, the communication unit including a communication port formed on an outside surface of the housing, a merging channel having an end which communicates with the communication port, and a branch channel having an end which communicates with the merging channel and the other end which communicates with the ink storage chamber, wherein the branch channel includes at least one first branch channel communicating with a lower layer area in the ink storage chamber and at least one second branch channel communicating with an upper layer area located higher than the lower layer area in a gravity direction in the ink storage chamber, wherein while ink is supplied to flow from the ink storage chamber to the outside, the ink flowing from the first branch channel and the second branch channel merges into the merging channel, and wherein in a case where an ink flow rate in the first branch channel is represented by Q1 and an ink flow rate in the second branch channel is represented by Q2, a ratio (Q1/Q2) between the ink flow rate in the first branch channel and the ink flow rate in the second branch channel while the ink is supplied is smaller than that while the ink flows backward to flow from the outside to the ink storage chamber.

Further features of the present invention will become apparent from the following description of exemplary embodiments (with reference to the attached drawings).

DESCRIPTION OF THE EMBODIMENTS

The ink cartridge disclosed in Japanese Patent Laid-Open No. 2005-007855 takes out ink from the plurality of inflow ports provided for the tube in amounts corresponding to inflow resistances and mixes the ink. However, a concentration gradient of pigments in the ink stored in the ink cartridge varies depending on a storage period, a position during storage, a type of ink, and the like and therefore, a concentration of pigments near the inflow ports is not constant. Accordingly, the ink cartridge disclosed in Japanese Patent Laid-Open No. 2005-007855 is effective if the ink cartridge has a predetermined concentration gradient of pigments or less. Depending on the level of the concentration gradient of pigments, however, variations in pigment concentration may be generated in the ink after mixed, causing density variations in a print image.

The ink cartridge disclosed in Japanese Patent Laid-Open No. 2006-102971 circulates and stirs the ink in the ink cartridge by a circulation unit. This requires driving of the circulation unit before using the ink. Since a printing operation cannot be performed while the circulation unit is driven, a print standby time is generated. Accordingly, there is a need for reduction of a stirring time.

Embodiments of the ink cartridge and the ink jet printing apparatus according to the present invention will now be described with reference to the attached drawings. It should be noted that the following embodiments show examples of preferred embodiments for carrying out the present invention, and the configurations of the present invention should not be limited thereto.

First Embodiment

1. Ink Jet Printing Apparatus

Figure 1:
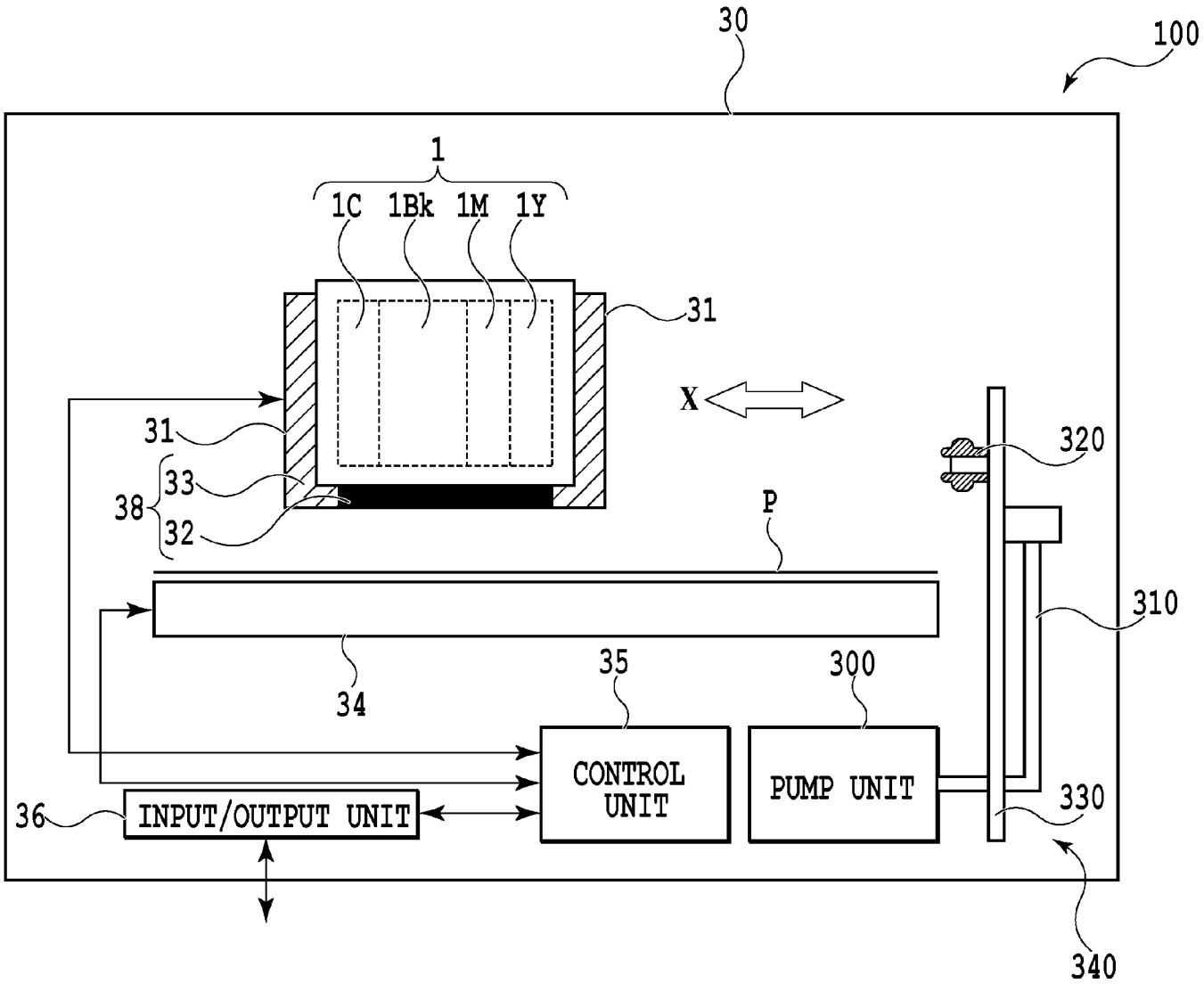
FIG. 1 is a diagram showing a schematic configuration of an ink jet printing apparatus according to an embodiment of the present invention.
Figure 8:
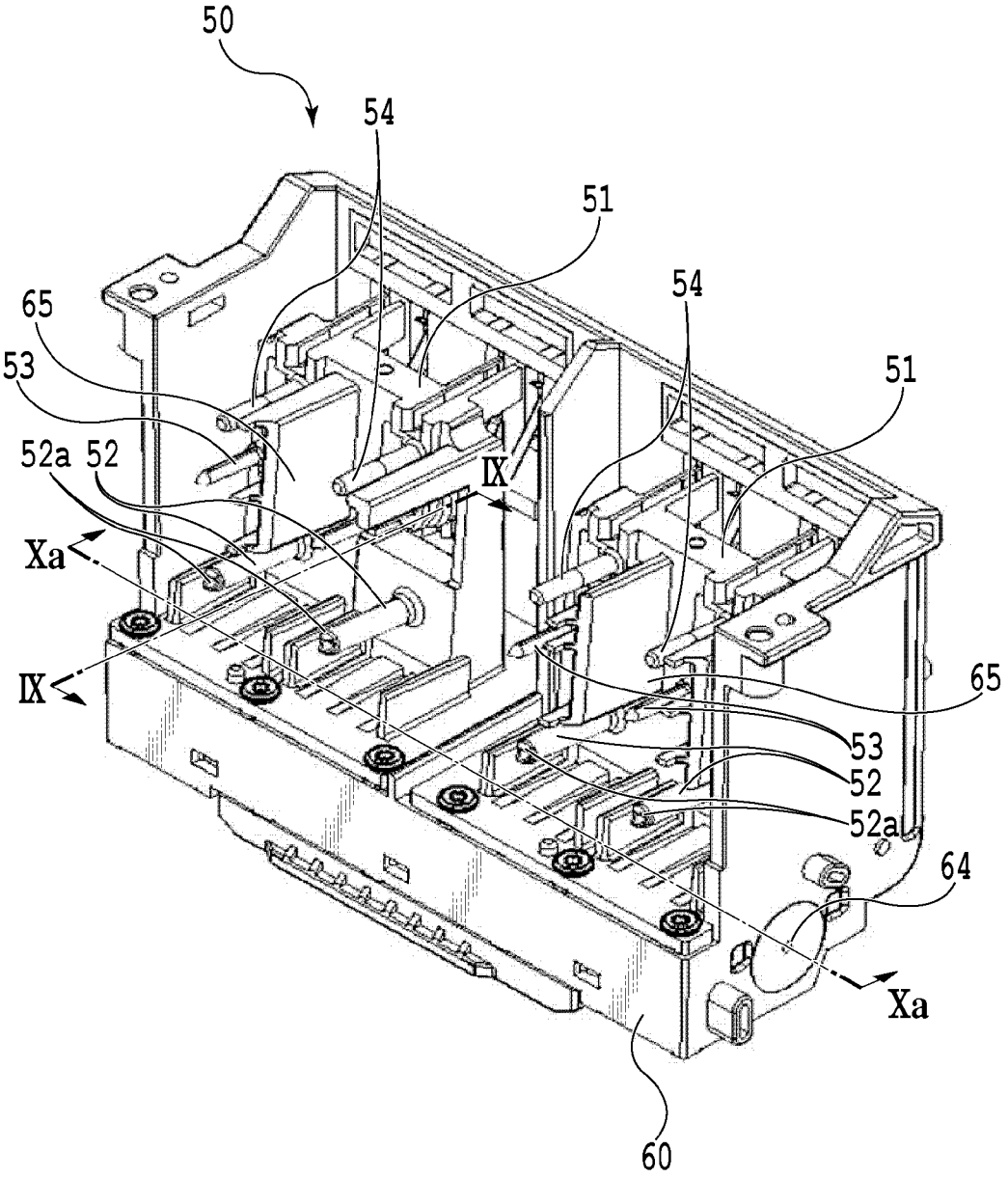
FIG. 8 is a perspective view showing a configuration of a cartridge mounting unit.

FIG. 1 is a diagram schematically showing a general configuration of an ink jet printing apparatus 100. On a printing apparatus body (hereinafter also referred to as an "apparatus body") 30 shown in FIG. 1, an ink cartridge 1 is removably mounted as an ink storage container. The apparatus body 30 includes a carriage 31, a print head 32, subtanks 51 (see FIGS. 8, 9 and 11), a conveying unit 34, a control unit 35, an input/output unit 36, and the like. Although not shown in particular, the printing apparatus body 30 also includes an outer cover that can be open or closed in removing, mounting, and replacing the ink cartridge, a feeding cassette into which print media are loaded, a feeding unit for feeding print media from the feeding cassette to the conveying unit 34, and the like. The printing apparatus body 30 further includes a discharge tray (not shown) for holding printed print media, an operation unit for various input operations, and the like. The printing apparatus body 30 may be connected to external devices (not shown) such as a computer, a digital camera, a memory card, and the like via the input/output unit 36.

The control unit 35 controls the entire printing apparatus body 30, controls information communications with the ink cartridge 1, analyzes and processes information received from the external devices via the input/output unit 36, outputs information to the input/output unit 36, and the like. For example, the control unit 35 controls operations of the driving units such as the carriage 31, the print head 32, the conveying unit 34, the feeding unit, and a pump unit 300 as a decompression unit (described later). The control unit 35 also performs control to read information unique to a cartridge such as an ink color, an initial amount of ink filled, and an ink consumption from a memory element 5 (FIG. 3B) as a storage unit provided for the ink cartridge 1 and control to write the information such as the ink consumption into the memory element 5. Furthermore, the control unit 35 analyzes and processes information such as printing instructions and image data received from the external devices via the input/output unit 36 and outputs information such as a remaining amount of ink to the input/output unit 36.

The subtanks 51 as mounting portions provided for the carriage 31 are configured such that ink cartridges 1C, 1Bk, 1M, and 1Ye for respectively storing therein inks of cyan (C), black (Bk), magenta (M), and yellow (Ye) can be removably mounted. The ink cartridge 1Bk has a greater width and a larger capacity as compared to the other three ink cartridges 1C, 1M, and 1Ye. Further, the print head 32 has ejection portions for individually ejecting inks of cyan (C), black (Bk), magenta (M), and yellow (Ye), so that each color of ink supplied from the ink cartridge 1 can be ejected from ejection ports of each ejection portion.

Figure 7:
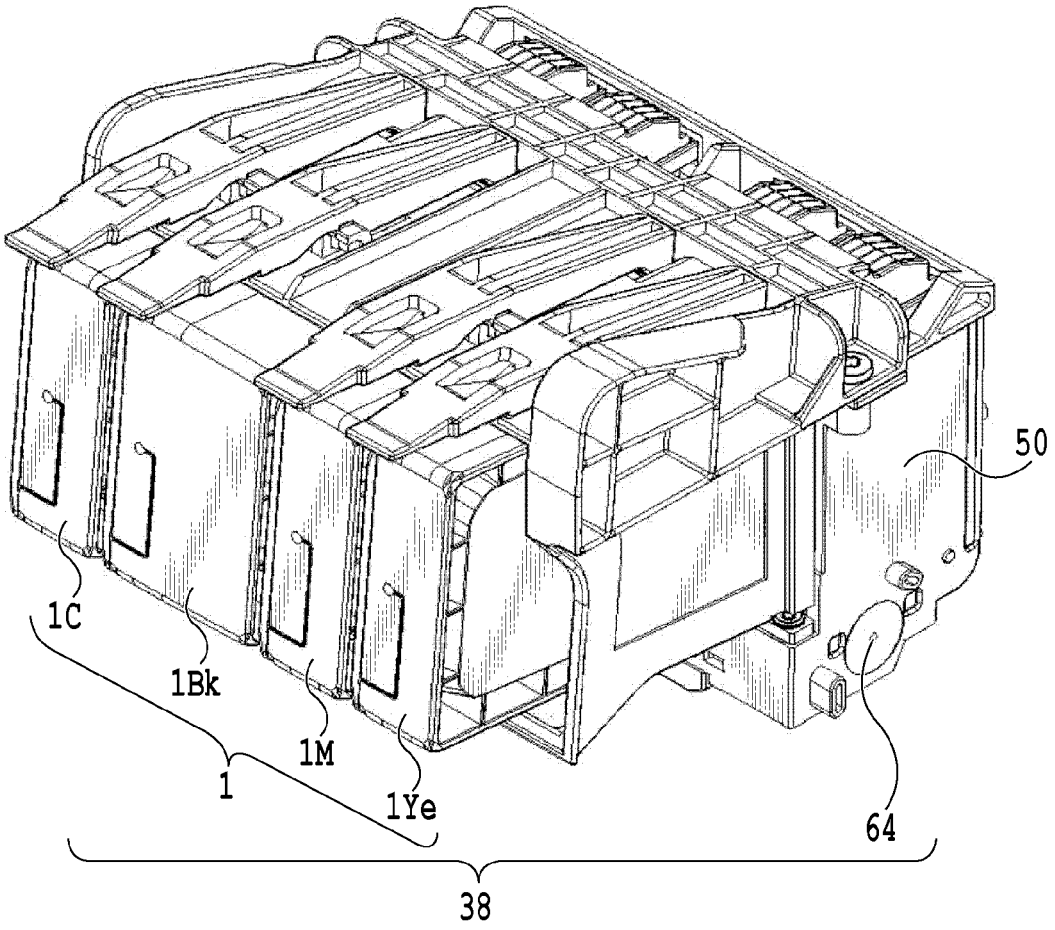
FIG. 7 is an enlarged perspective view showing in detail a main part of a print head unit shown in FIG. 1.

To remove, mount, or replace the ink cartridge 1 with respect to the carriage 31, a user first opens the outer cover (not shown) that covers the carriage 31, the conveying unit 34, and the like. Upon detection of the open state of the outer cover by the printing apparatus body, the carriage 31 moves to a cartridge replacement position (not shown). The user can mount (see FIG. 7) or remove (see FIG. 8) the ink cartridge 1 with respect to a head unit 38 mounted on the carriage 31 in the cartridge replacement position. It should be noted that the head unit 38 includes a cartridge mounting unit 50 (described later) and the print head 32 (see FIG. 9).

If the user closes the outer cover after removing, mounting, or replacing the ink cartridge 1, the closed state is detected by an external sensor (not shown). Upon detection of the closed state, the control unit 35 of the printing apparatus body 30 reads ink color information from the memory element 5 of the ink cartridge 1 mounted on the carriage 31. The control unit 35 determines, based on the read ink color information, whether all of the colors (four colors in the present embodiment) of the ink cartridge 1 are mounted on the carriage 31. If it is determined that there is a color of the ink cartridge 1 that is not mounted on the carriage 31, the control unit 35 outputs an instruction to perform error display to the operation unit or the external device to display an error message on a display panel of the operation unit or a display unit of the external device. Meanwhile, if it is determined that all of the colors of the ink cartridge are mounted on the carriage 31, the ink jet printing apparatus 100 becomes a printable condition.

If a printing instruction is sent from the external device or the operation unit to the control unit 35, the control unit 35 determines whether the printing apparatus is under a printable condition. If it is under a printable condition, the feeding unit (not shown) picks a sheet of a print medium P one by one loaded into the feeding cassette (not shown) and feeds the picked sheet of the print medium P toward the conveying unit 34. The conveying unit 34 includes a platen for supporting the under surface of the print medium P, a conveying roller that can intermittently convey a print medium, a driving unit for rotary driving the conveying roller, and the like to convey the print medium P fed by the feeding unit to the discharge tray (not shown). In intermittent conveying operations performed by the conveying unit 34 on the print medium P, while conveyance is suspended between one conveying operation and the following conveying operation, the carriage 31 moves above the print medium P in an X direction crossing (perpendicular to, in the present embodiment) a direction in which the print medium P is conveyed. While ink is ejected from the print head 32 to the print medium P during movement of the carriage 31, an image is formed on the print medium. Accordingly, repeating the movement of the carriage and the ink ejection of the print head along with the conveyance of the print medium can form an image on the print medium.

1-1. Head Unit

Figure 9:
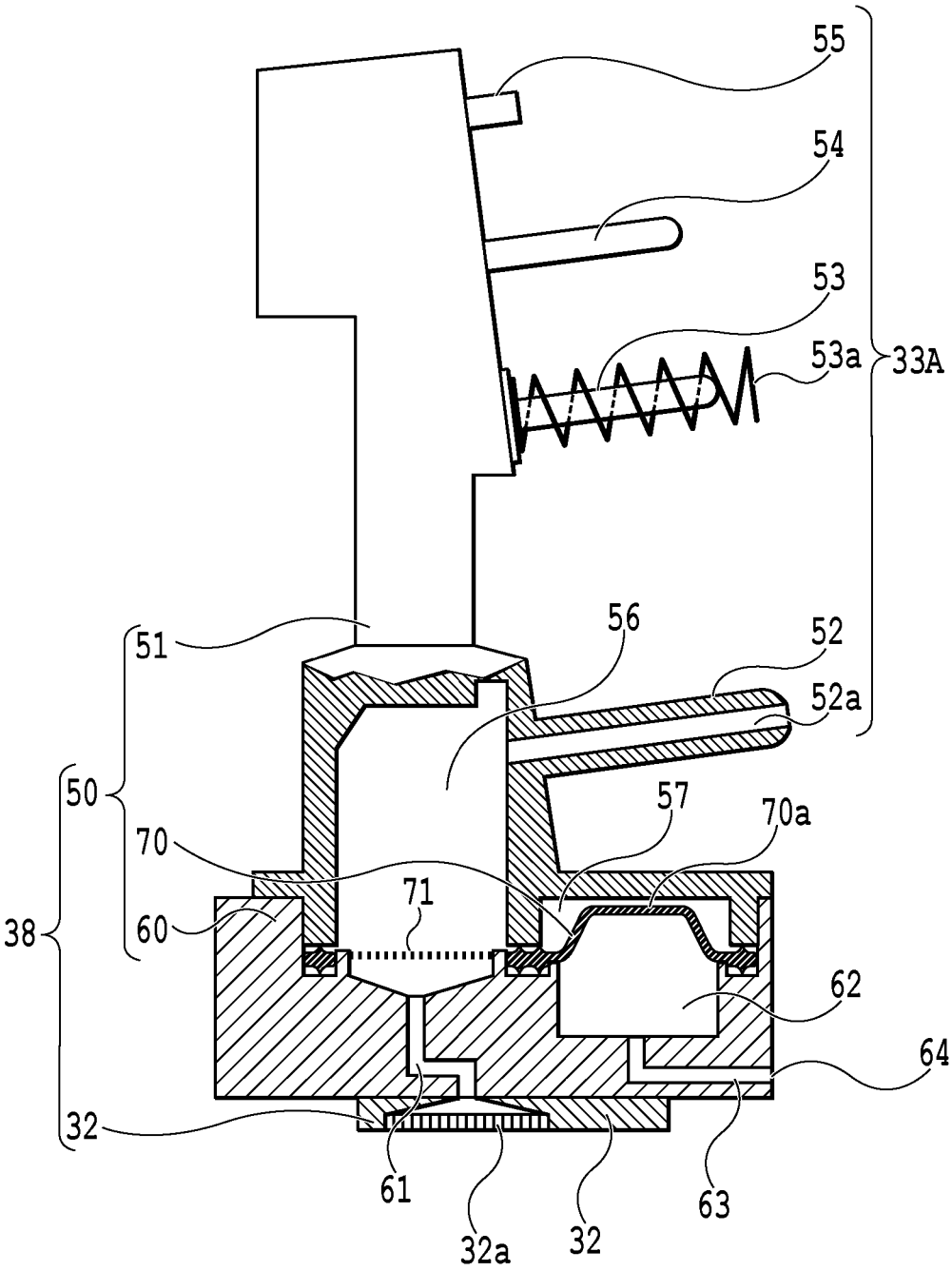
FIG. 9 is a partial longitudinal sectional view schematically showing the cross section taken along line IX-IX of FIG. 8.

Next, a more detailed description will be given of the configuration of the head unit 38 mounted on the carriage 31 of the ink jet printing apparatus 100. FIG. 9 is a partial longitudinal sectional view showing the configuration of the head unit 38 according to the present embodiment. The head unit 38 has the print head 32 having an ejection port 32*a* that can eject ink and the cartridge mounting unit 50 on which the ink cartridge 1 is removably mounted and which can supply ink delivered from the ink cartridge 1 to the print head 32. The cartridge mounting unit 50 has the subtanks 51 as mounting portions on which the ink cartridge 1 can be mounted, a supporting portion 60 for supporting the subtanks 51 and the print head 32, and elastic members 70 provided between the subtanks 51 and the supporting portion 60. The subtank 51 is provided with an apparatus body interface portion 50A removably connected with a cartridge interface portion 1A (see FIG. 2) formed on a front surface 2*c*1 of the ink cartridge 1, which will be described later.

The apparatus body interface portion 50A has an ink supply tube 52, a tear pin 53, and a positioning pin 54, which can be respectively inserted into or removed from a tube insertion port 8, an atmosphere communication hole 7, and a positioning hole 6 of the cartridge interface portion 1A. The subtank 51 is provided with a joint chamber 56 for storing therein ink flowing from the ink cartridge 1 via the ink supply tube 52 and an ink chamber 57 communicating with the joint chamber 56. The joint chamber 56 is defined by a lower portion of the subtank 51 and the supporting portion 60, and the ink chamber 57 is defined by the elastic member 70 that is gas-liquid impermeable and tightly fixed on the supporting portion 60.

Figure 10A:
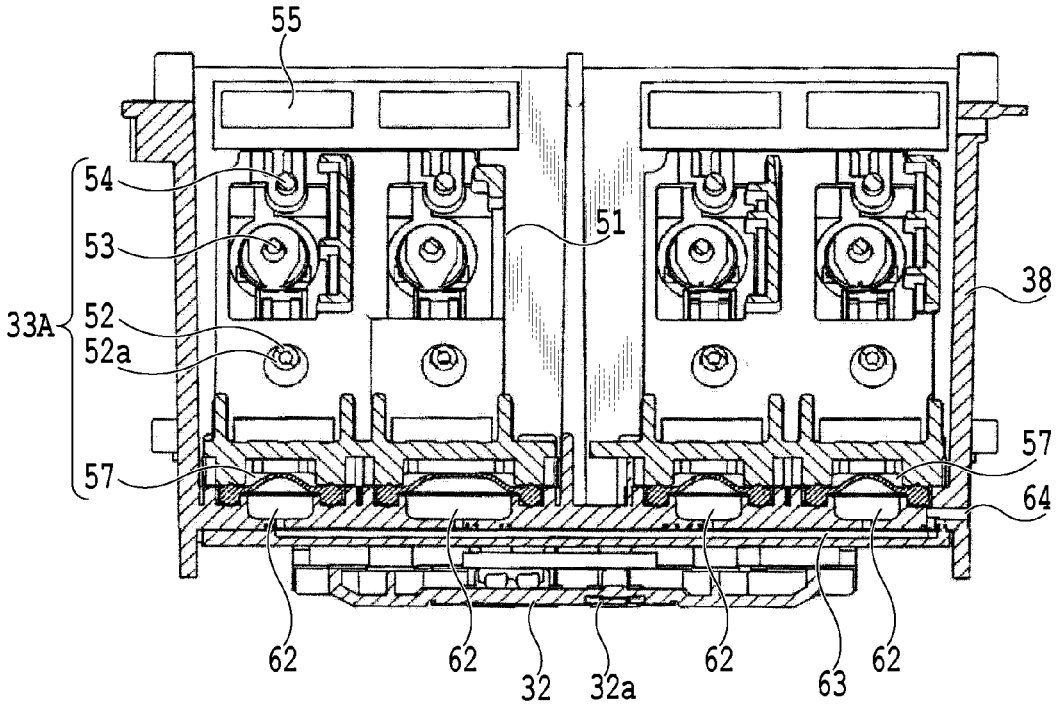
FIG. 10A is a partial longitudinal sectional view schematically showing the cross section taken along line Xa-Xa of FIG. 8.
Figure 10B:
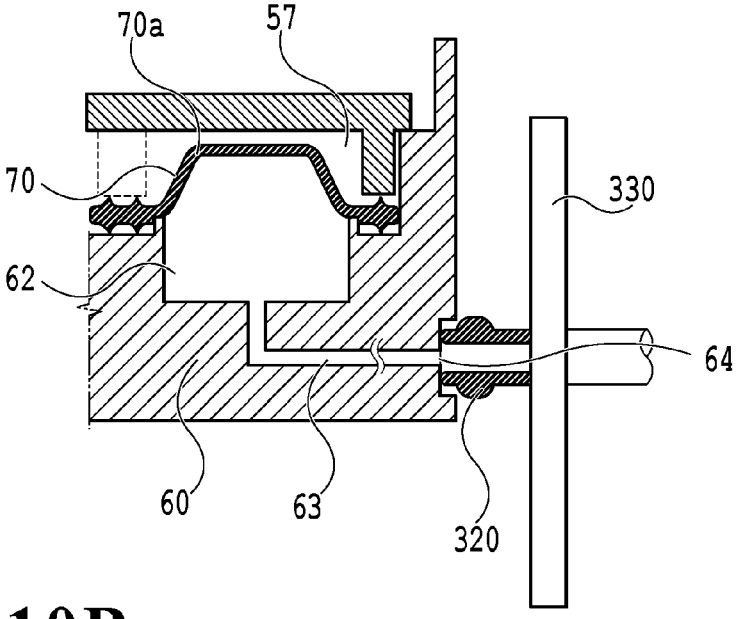
FIG. 10B is a cross-sectional view showing an ink backflow unit.
Figure 11:
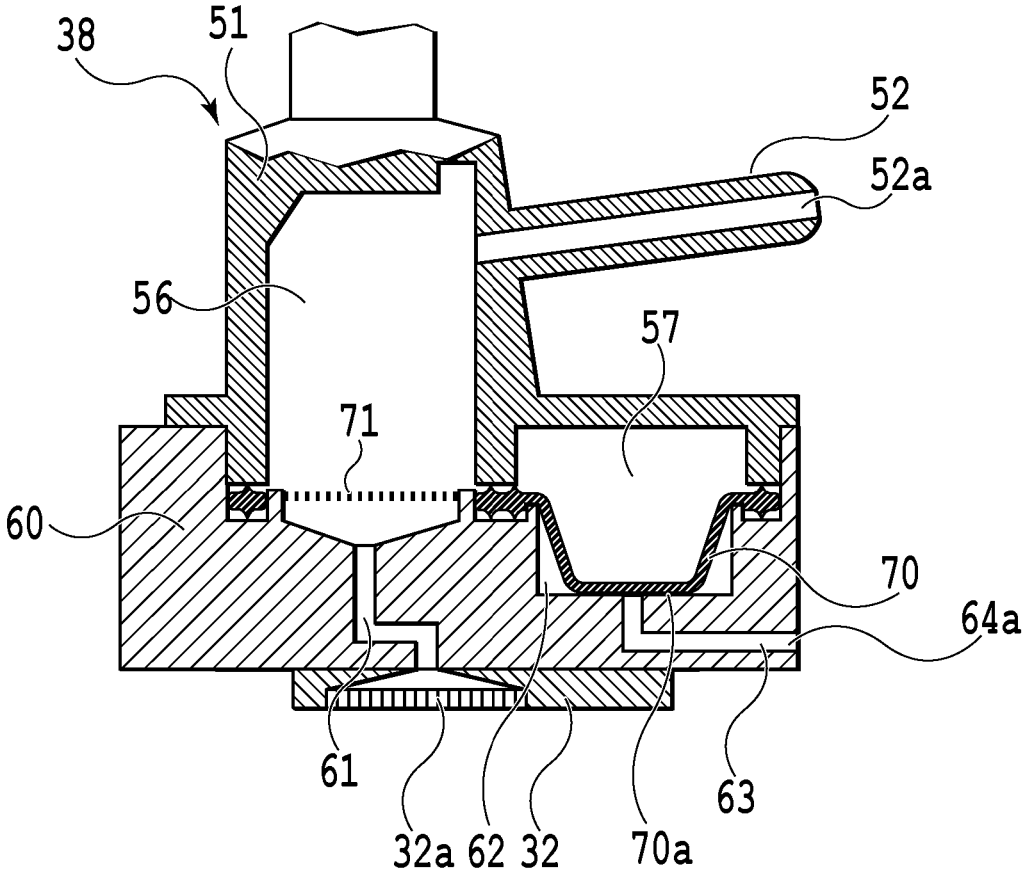
FIG. 11 is a longitudinal sectional view schematically showing a state in which an elastic member shown in FIG. 10B is reversed.

The supporting portion 60 has an ink channel 61 for supplying ink in the joint chamber 56 to the print head 32, a decompression chamber 62 defined by the elastic member 70 in a manner being separated from the ink chamber 57, and a decompression channel 63 for communication between the decompression chamber 62 and an outside space. The elastic member 70 has an elastic portion 70*a* that is deformed depending on pressure in the decompression chamber 62. The elastic portion 70*a* protrudes upwardly as shown in FIG. 9 and FIG. 10B if the pressure in the decompression chamber 62 is equal to or greater than a predetermined level, whereas the elastic portion 70*a* protrudes downwardly as shown in FIG. 11 if the pressure in the decompression chamber 62 is less than a predetermined level (in a decompressed state). Note that an opening formed at an end of the decompression channel 63 is, as shown in FIG. 10B, configured to be openably covered by a suction pad 320 of a decompression unit. Note that the subtanks 51 and the supporting portion 60 having the above-described configurations form an ink delivery unit that allows ink to flow between the ink cartridge 1 and the print head 32.

The present embodiment employs a structure for removably mounting the head unit 38 on the carriage 31. However, the present invention should not be limited to this embodiment. The present invention may take a form in which the print head 32 and the cartridge mounting unit 50 are removably mounted on the carriage 31 individually. The cartridge mounting unit 50 may also be integrated into the carriage 31, and only the print head 32 may be removably mounted on the carriage 31. Furthermore, both of the print head 32 and the cartridge mounting unit 50 may be integrated into the carriage 31. In short, the carriage 31 only needs to have a configuration in which the print head can be mounted on the carriage 31 in a removable or fixed manner, and the ink cartridge 1 is removably mounted on the carriage 31.

2. Ink Cartridge

Next, an exemplary ink cartridge that may be used in the ink jet printing apparatus 100 shown in FIG. 1 will be described with reference to FIGS. 2 to 5A and 5B. The four ink cartridges 1C, 1Bk, 1M, and 1Ye used in the present embodiment have the same basic configuration other than types of ink stored therein, cartridge widths (the width of the ink cartridge 1Bk is greater than the width of the ink cartridge 1C, 1M, or 1Ye), and identification portions 9. By way of example, the configuration of the ink cartridge 1M will be described.

Figure 2:
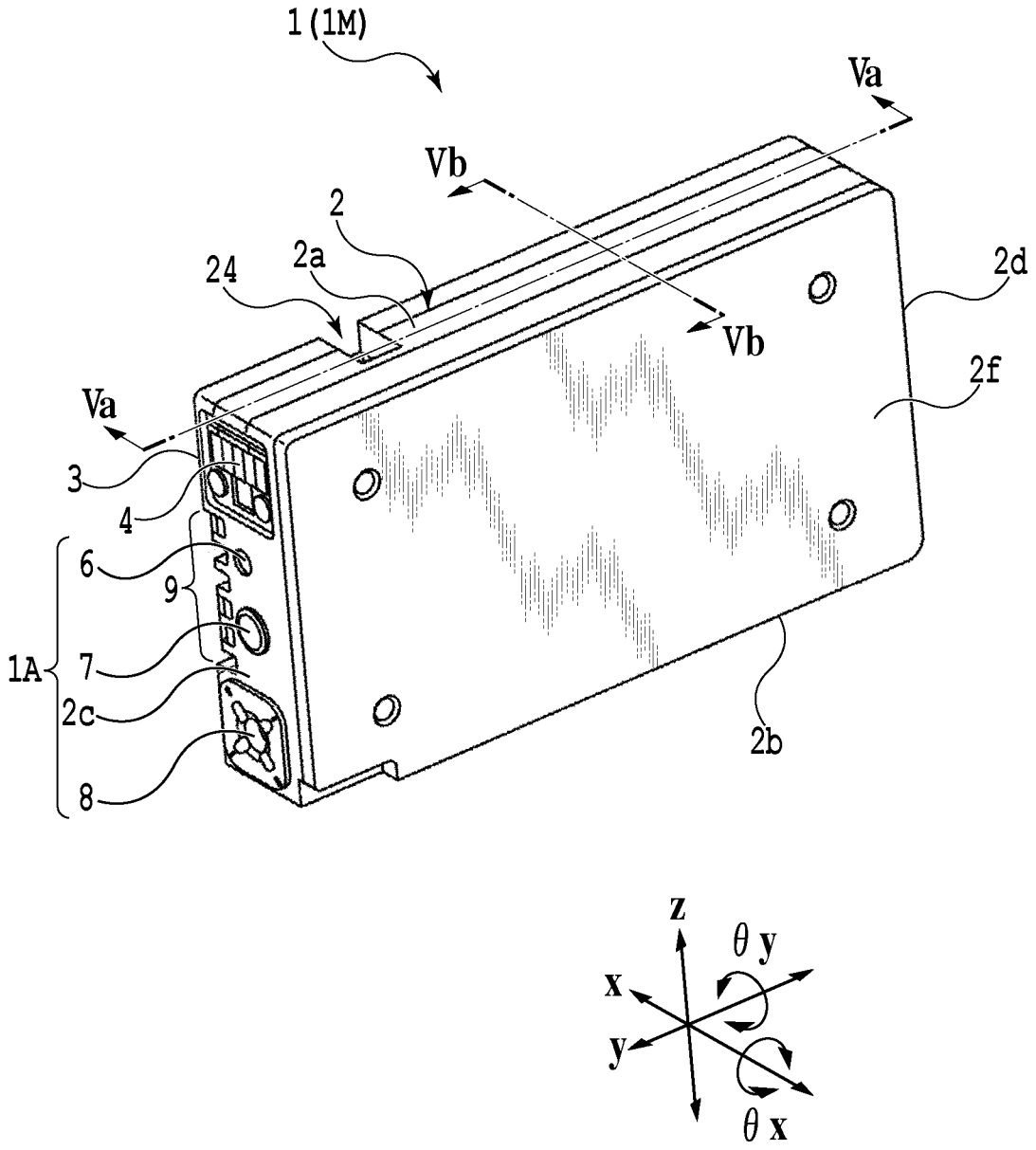
FIG. 2 is a perspective view showing an appearance of an ink cartridge in the present embodiment.
Figure 3A:
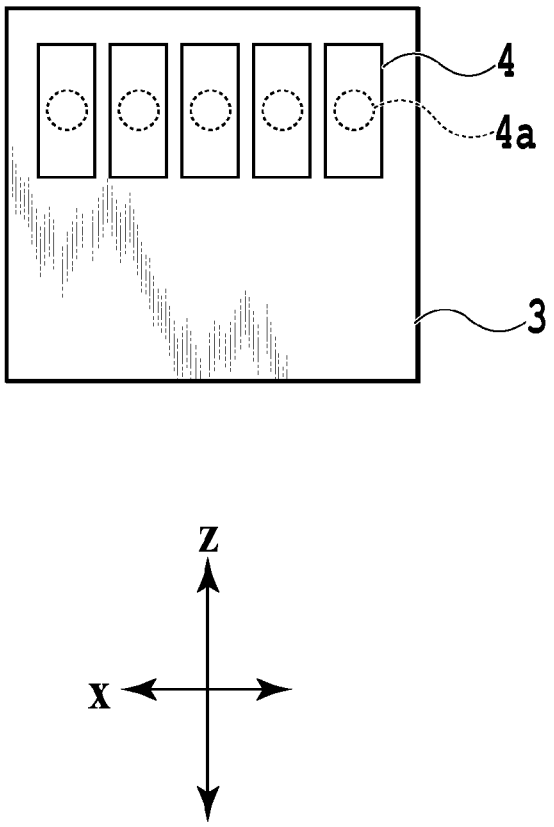
FIG. 3A is a front view showing an appearance of a substrate provided for the ink cartridge shown in FIG. 2.
Figure 3B:
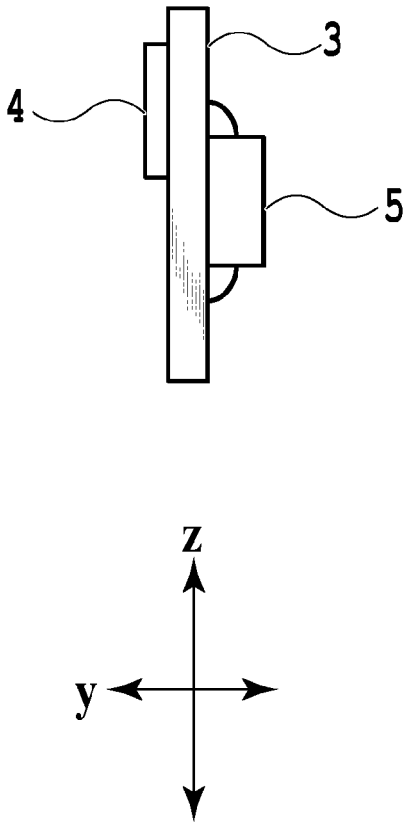
FIG. 3B is a side view of the substrate shown in FIG. 3A.
Figure 4:
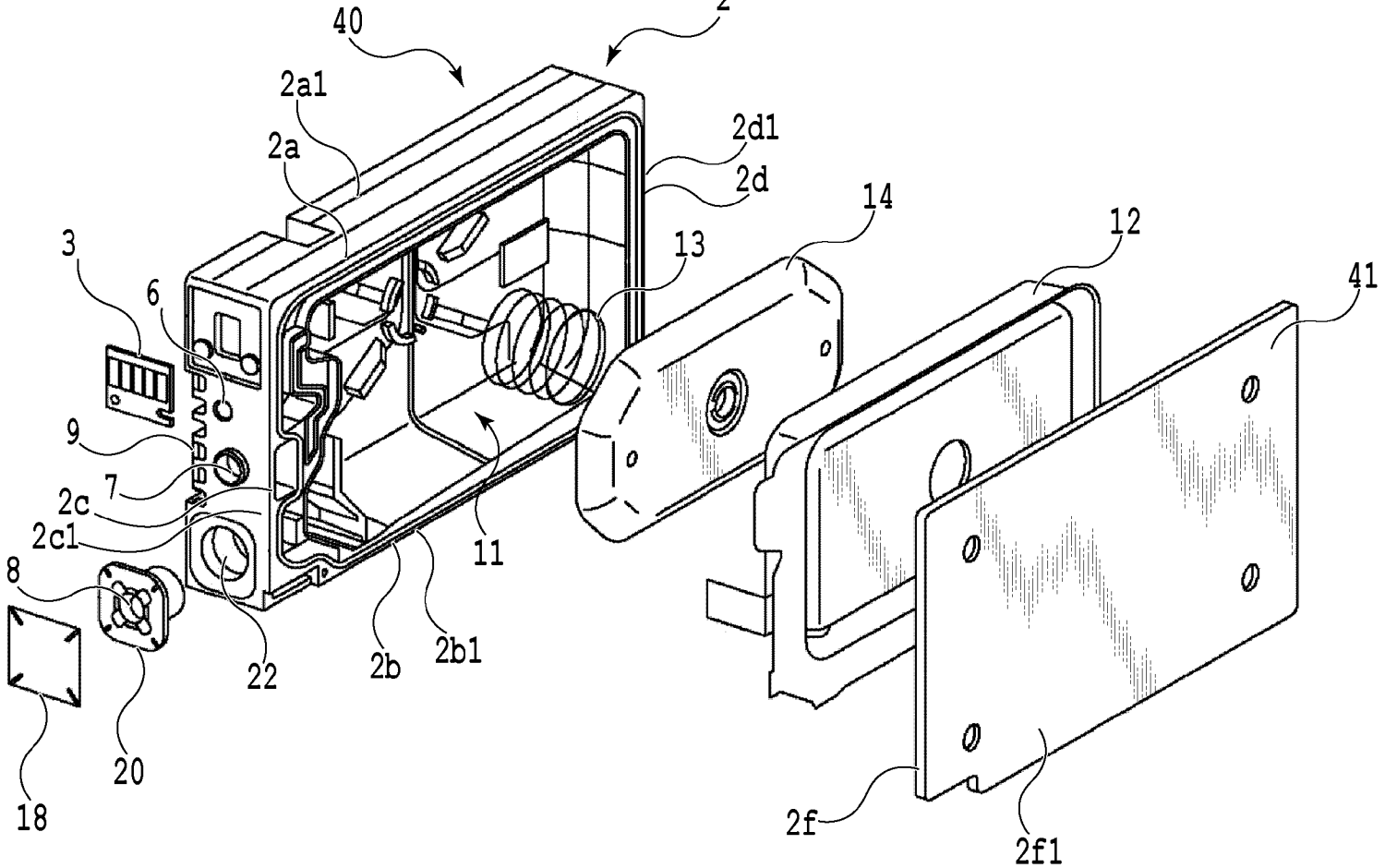
FIG. 4 is an exploded perspective view of the ink cartridge shown in FIG. 2.
Figure 5A:
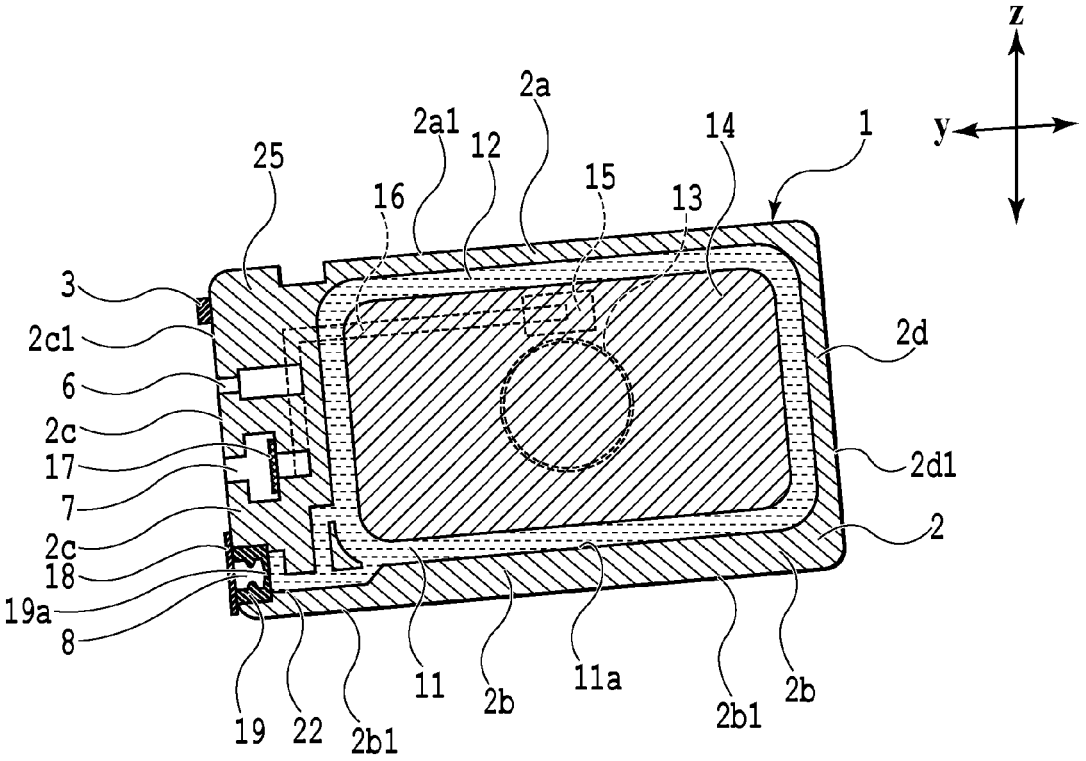
FIG. 5A is a cross-sectional view taken along line Va-Va of the ink cartridge shown in FIG. 2.
Figure 5B:
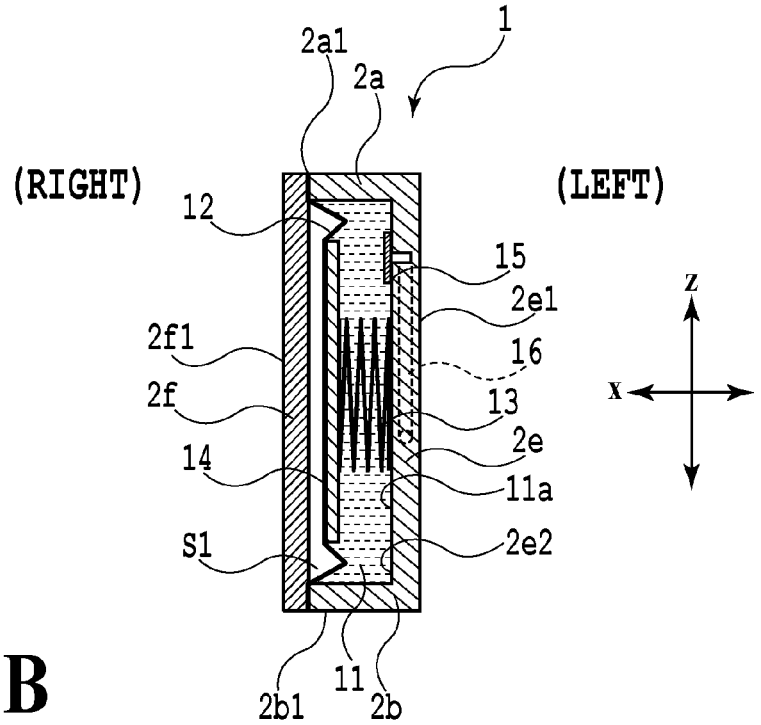
FIG. 5B is a cross-sectional view taken along line Vb-Vb of the ink cartridge shown in FIG. 2.

FIG. 2 is a perspective view showing an appearance of the ink cartridge 1M in the first embodiment of the present invention. FIG. 3A is a front view showing an appearance of a substrate 3 provided for the ink cartridge 1 shown in FIG. 2 and FIG. 3B is a side view showing the appearance of the substrate 3 provided for the ink cartridge 1 shown in FIG. 2. FIG. 4 is an exploded perspective view of the ink cartridge shown in FIG. 2. FIG. 5A is a cross-sectional view taken along line Va-Va of FIG. 2 and FIG. 5B is a cross-sectional view taken along line Vb-Vb of FIG. 2. It should be noted that vertical and horizontal directions, top, bottom, front, back, and side surfaces, and the like of the ink cartridge are defined in a state in which the ink cartridge is mounted on the mounting portion, that is, based on the orientation (position) of the ink cartridge 1 in use.

2-1. Housing

As shown in FIG. 2, the ink cartridge 1 as an ink storage container has a housing 2 in a rectangular shape having an ink storage chamber 11. The housing 2 is made up of a first housing member 40 including a top wall 2*a*, a bottom wall 2*b*, a front wall 2*c*, a back wall 2*d*, and a left wall 2*e* and a second housing member 41 forming a right wall 2*f*. The second housing member 41 serves as a cover member for closing an opening formed by ends of the top wall 2*a*, the front wall 2*c*, the back wall 2*d*, and the left wall 2*e* of the first housing member 40. The ink storage chamber 11 is a space formed by an inner wall surface of the first housing member 40 and a flexible member 12 that is in close contact with the inner wall surface of the first housing member 40, and ink is stored in this space. Note that the flexible member 12 in the present embodiment is made of a sheet that has flexibility and gas-liquid impermeability. In this housing 2, the outer surfaces of the top wall 2*a*, the bottom wall 2*b*, the front wall 2*c*, the back wall 2*d*, the left wall 2*e*, and the right wall 2*f* are referred to as a top surface 2*a*1, a bottom surface 2*b*1, a front surface 2*c*1, a back surface 2*d*1, a left surface 2*e*1, and a right surface 2*f*1, respectively.

In FIG. 2, an X axis direction is a direction corresponding to the width of the ink cartridge 1 and is also a direction in which the ink cartridge 1 mounted on the carriage 31 moves (moving direction of the carriage 31). A Y axis direction is a direction corresponding to the depth of the ink cartridge 1 and is also a direction in which the cartridge is removed. A Z axis direction is a vertical direction (a gravity direction) of the ink cartridge and a direction perpendicular to the X axis direction and the Y axis direction. Furthermore, a θx direction is a rotation direction around the X axis serving as a rotation center axis, a θy direction is a rotation direction around the Y axis serving as a rotation center axis, and a θz direction is a rotation direction around the Z axis serving as a rotation center axis.

Since the present embodiment employs the housing having a rectangular shape, the X axis direction is perpendicular to the left surface 2*e*1 and the right surface 2*f*1, the Y axis direction is perpendicular to the front surface 2*c*1 and the back surface 2*d*1, and the Z axis direction is perpendicular to the top surface 2*a*1 and the undersurface (bottom surface) 2*b*1.

As will be described later, however, the shape of the housing 2 that can be applied to the present embodiment is not limited to the rectangular shape. For example, all or part of the surfaces forming the housing 2 may be curved surfaces or inclined surfaces. In a case where all or part of the surfaces forming the housing 2 are curved surfaces or inclined surfaces, the X, Y, and Z axes may not be perpendicular to these surfaces.

2-2. Cartridge Interface Portion

As shown in FIGS. 2, 4, 5A, and 5B, the front surface 2*c*1 of the housing 2 is provided with the cartridge interface portion 1A that is removably connected to the above-mentioned apparatus body interface portion 50A. The cartridge interface portion 1A includes the substrate 3 having electric contacts 4 provided thereon, the positioning hole 6 as a positioning portion, the atmosphere communication hole 7 as an atmosphere communication portion, the tube insertion port 8 as a communication port, the identification portion 9, and the like. The electric contacts 4, the positioning hole 6, the atmosphere communication hole 7, the tube insertion port 8, and the identification portion 9 are connected to electric contacts (electric connection portion) 55, the positioning pin 54, the tear pin 53, the ink supply tube 52, and an identification member 65, respectively.

The configuration of the ink cartridge 1 will now be described with an emphasis on the cartridge interface portion 1A. As shown in FIGS. 2, 4, 5A and 5B, the tube insertion port 8 provided on the front surface 2*c*1 of the housing 2 is located at a lower portion in the gravity direction (vertical direction) with a predetermined distance from the top wall 2*a* of the housing 2, and is located near the bottom wall 2*b* in the present embodiment. The tube insertion port 8 is formed by an opening of a seal member 19 inserted into one end portion of a communicating channel (communication portion) 22 formed on a lower portion of the housing 2. The seal member 19 is formed by a cylindrical elastic body (for example, rubber) and inserted into and fixed to one end portion of the communicating channel 22. The opening forming the above-mentioned tube insertion port 8 is formed on one end portion of the communicating channel 22.

An end portion in the back of the seal member 19 (a side closer to the ink storage chamber 11 than the tube insertion port 8) is provided with a slit 19*a* that can elastically be open or closed. The slit 19*a* is closed while the ink supply tube 52 is not disposed in the slit 19*a*. While the slit 19*a* of the seal member 19 is closed, the communicating channel 22 is blocked, and the tube insertion port 8 and the ink storage chamber 11 are in a noncommunication state. Further, if the ink supply tube 52 is inserted into the communicating channel 22, the slit 19*a* of the seal member 19 is extended and opened by the ink supply tube 52 to secure communication between the ink supply tube 52 and the ink storage chamber 11. At the same time, to avoid leakage of ink, the inner peripheral surface of the seal member 19 is elastically in close contact with the outer peripheral surface of the ink supply tube 52. The connection between the communicating channel 22 and the ink supply tube 52 in this manner allows the ink in the ink storage chamber 11 to be supplied to the ink supply tube 52.

In a case where the ink cartridge 1 is mounted on the subtank 51 of the head unit 38 provided for the apparatus body 30, the ink supply tube 52 of the apparatus body interface portion 50A is inserted into the tube insertion port 8 of the ink cartridge 1. Accordingly, the movement of the ink cartridge 1 in directions along the front surface 2*c*1 of the housing 2 (X axis and Z axis directions) is limited. In other words, the tube insertion port 8 serves also to reduce positional errors of the ink cartridge 1 in a surface direction of the front surface 2*c*1. In the present embodiment, the tube insertion port that is always open as a coupling portion is employed, but the configuration of the coupling portion is not limited to the one which is always open. More specifically, the coupling portion does not need to be open before the ink supply tube is inserted. Any coupling portion may be employed as long as the ink supply tube 52 can be inserted into the coupling portion.

FIG. 5A shows the ink cartridge 1 before mounted on the subtank 51, that is, the ink cartridge 1 before used. In this unused state, a sealing film 18 as a sealing member is tightly fixed to a portion around the tube insertion port 8 so as to completely seal the tube insertion port 8. Accordingly, the sealing film 18 serves as an ink leakage prevention unit for preventing ink leakage from the ink storage chamber 11 before the use of the cartridge, such as in physical distribution. When the ink cartridge 1 is mounted, the sealing film 18 is unsealed by the penetration of the ink supply tube 52.

The substrate 3 having the electric contacts 4 is disposed on the front surface 2*c*1 of the housing 2 at a position (upper position) closer to the top surface 2*a*1 rather than the tube insertion port 8. As shown in FIG. 3A, a plurality of (five in the figure) electric contacts 4 are provided on the surface of the substrate 3, and a memory element 5 is provided on the back of the substrate 3. The electric contacts 4 and the memory element 5 are connected by wiring via a through hole provided on the substrate.

The memory element 5 is an IC chip having an information storage unit (memory unit) and a control circuit. The information storage unit stores therein information unique to the cartridge 1. Examples of the information unique to the cartridge 1 include information about a color of ink stored in the ink storage chamber 11, information about an initial amount of ink filled, information about a consumption amount of ink supplied from the ink storage chamber to the outside, and information about a production data of a cartridge. The configuration of the information storage unit (memory unit) is not particularly limited, and various forms may be applied, for example, an EEPROM, FeRAM, and the like. Meanwhile, the control circuit is configured to be able to analyze the information transmitted from the control unit 35 of the printing apparatus body 30, write the information into the information storage unit, read the information from the information storage unit, and output the information to the control unit 35. For example, the control circuit can analyze ink consumption information and ink color information transmitted from the control unit 35 and write the ink consumption information, the ink color information, and the like into the information storage unit. Furthermore, the control circuit can also read the ink color information, the ink consumption information, and the like stored in the information storage unit and output the read information to the control unit 35.

The electric contacts (electric connection portion) 4 near the cartridge, provided for the cartridge 1, can be electrically connected to the electric contacts (electric connection portion) 55 near the body, and as shown in FIG. 3A, the electric contact 4 partially contacts with the electric contact 55 at a contact position 4*a*. The surface of the substrate 3 is provided with the plurality of electric contacts 4. Examples of the electric contacts 4 include a contact which receives a clock signal from the printing apparatus body, a contact which receives or outputs data such as an ink consumption, a contact to which power for operating a memory element is supplied from the printing apparatus body, and a contact connected with a ground. While FIG. 3A shows the case where the number of electric contacts 4 is five, the number of electric contacts is not limited to five and may be appropriately adjusted.

In the present embodiment, the electric contacts 4 may be arranged at positions that can face the electric contacts 55 along the direction in which the cartridge is mounted (Y axis direction). Accordingly, it is preferable to arrange the electric contacts 4 on a surface (for example, a surface of the substrate 3 crossing the direction in which the cartridge is mounted) crossing the direction in which the cartridge is mounted (Y axis direction). By connecting the electric contacts 4 near the cartridge with the electric contacts 55 near the body, the memory element 5 of the ink cartridge 1 becomes electrically connected with the control unit 35 of the printing apparatus body 30. This allows the control unit 35 to read the information (for example, the above-mentioned information unique to the cartridge) stored in the memory unit 5. The control unit 35 can also write the information (for example, information about an ink amount consumed by a printing operation) into the memory element 5.

2-3. Ink Storage Chamber

Next, an internal configuration of the ink cartridge 1 will be described with an emphasis on the configuration of the ink storage chamber 11. FIG. 4 is an exploded perspective view of the ink cartridge 1 shown in FIG. 2. The ink storage chamber 11 is a chamber storing ink in an internal space formed by the inner wall surface of the first housing member 40 of the housing 2 and the flexible member 12 (a sheet having flexibility) that is in close contact with an edge of the inner wall surface of the first housing member 40.

Inside the ink storage chamber 11, there are arranged a negative pressure generation spring 13 as a negative pressure generation member for generating a negative pressure in the ink storage chamber 11 and a plate member 14 having a rectangular shape that is smaller than the inner wall surface of the first housing member 40. One end of the negative pressure generation spring 13 engages with an inner surface 2*e*2 of the left wall 2*e* of the first housing member 40 and the other end of the negative pressure generation spring 13 engages with the plate member 14. The negative pressure generation spring 13 maintains the negative pressure in the ink storage chamber 11 within a predetermined range by urging the flexible member 12 in a direction in which the ink storage chamber expands via the plate member 14.

In a case where ink in the ink storage chamber 11 decreases by being supplied from the ink cartridge 1 to the outside space, that is, by being supplied to the printing apparatus body 30, the negative pressure in the ink storage chamber 11 significantly increases on condition that an internal volume of the ink storage chamber 11 is constant. In the present embodiment, however, if ink in the ink storage chamber 11 decreases, the negative pressure generation spring 13 contracts accordingly and the plate member 14 moves in a direction in which the internal volume of the ink storage chamber 11 decreases. Accordingly, a significant increase in the negative pressure can be suppressed, and the negative pressure can be kept at a predetermined level.

Figure 6A:
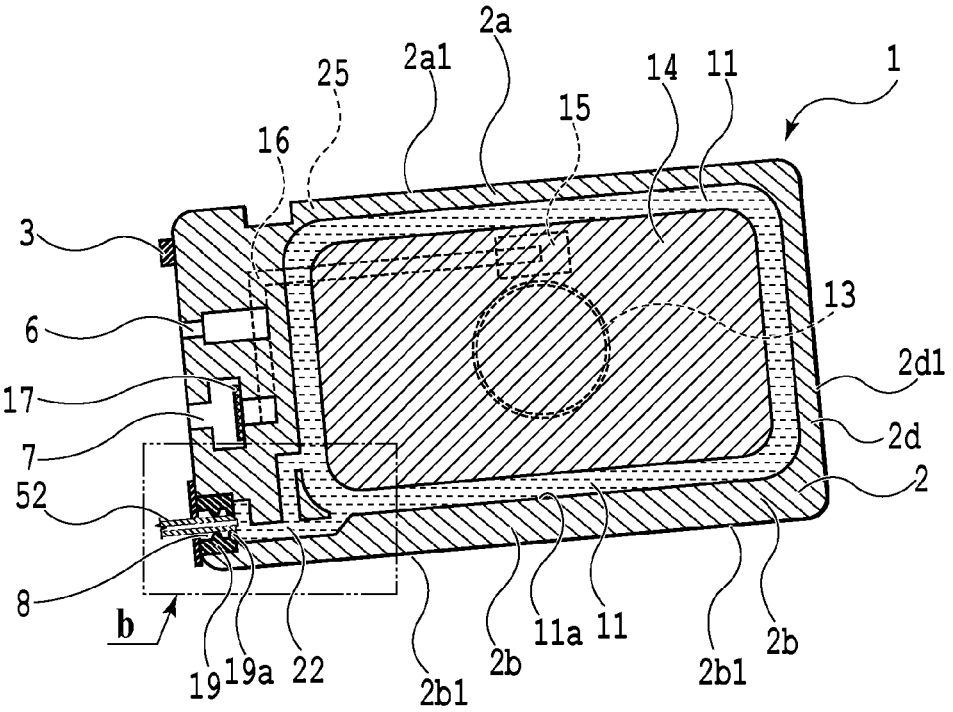
FIG. 6A is a cross-sectional view of the ink cartridge shown in FIG. 2.
Figure 6B:
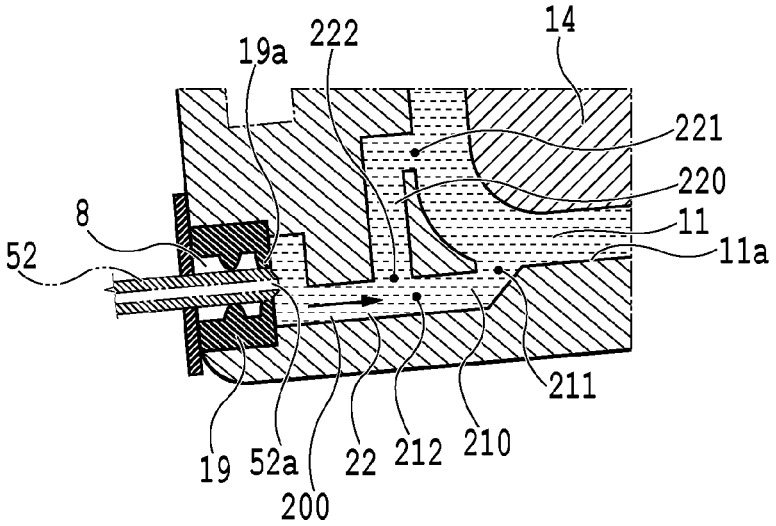
FIG. 6B is a partially enlarged cross-sectional view of the ink cartridge shown in FIG. 6A.

Note that a space between the ink storage chamber 11 and the second housing member 41 (non-ink storage space) communicates with an outside space of the ink cartridge 1 via a porous filter 15, an atmosphere communication channel 16, and the atmosphere communication hole 7 provided on the right wall 2*f* of the ink cartridge 1 (see FIGS. 6A and 6B). More specifically, the left wall 2*e* of the ink cartridge 1 is provided with the atmosphere communication channel 16 formed by a serpentine groove, and one end of the groove communicates with the non-ink storage space and the other end of the groove communicates with the atmosphere communication hole 7. Then, a label 25 is attached to the outer surface of the left wall 2*e* to cover the serpentine groove, and the groove covered with the label 25 functions as an atmosphere communication channel for the communication between the non-ink storage space S1 (see FIG. 5B) and the atmosphere communication hole 7. Accordingly, if the plate member 14 tries to move in a direction in which the internal volume of the ink storage chamber 11 decreases, air is captured into the space (non-ink storage space) between the ink storage chamber 11 and the second housing member 41 from an air opening 26 via the atmosphere communication channel 16.

2-4. Supplying Ink and Ink Supply Channel

In the ink cartridge 1 mounted on the subtank 51 of the apparatus body 30, if ink in the ink storage chamber 11 is consumed by an ink ejection operation of the print head 32, the plate member 14 moves against the negative pressure generation spring 13. As the consumption of ink proceeds and the plate member 14 moves, the negative pressure in the ink storage chamber 11 further increases, and if the negative pressure reaches or exceeds a meniscus force of the porous filter 15, air is introduced from the atmosphere communication channel 16 through the porous filter 15 into the ink storage chamber 11. After that, air is introduced from the atmosphere communication channel 16 into the ink storage chamber 11 by an amount of ink supplied, and accordingly the negative pressure in the ink storage chamber 11 is kept within a predetermined range, and will not increase more than necessary. In this manner, in the present embodiment, since air flows into the ink storage chamber 11 during the ink supply operation, most of the ink stored in the ink storage chamber 11 may be used up.

Here, with reference to FIGS. 6A and 6B, a description will be given of the configuration of the communicating channel 22 as a communication unit for allowing the ink cartridge 1 to communicate with the outside space. FIG. 6A shows a state in which the ink supply tube 52 is disposed in the tube insertion port (communication port) 8 of the ink cartridge 1, and FIG. 6B is an enlarged view showing a portion near the tube insertion port 8 shown in FIG. 6A (an enlarged view of portion b of FIG. 6A). The communicating channel 22 in the present embodiment includes a merging channel 200 communicating with the tube insertion port (communication port) 8 formed on the front surface 2*c*1 of the housing 2 and a plurality of branch channels, each having one end portion which communicates with the merging channel 200 and the other end portion which communicates with the ink storage chamber 11. In the present embodiment, the branch channel includes two branch channels: a first branch channel 210 and a second branch channel 220. Furthermore, an opening 221 for communication between the second branch channel 220 and the ink storage chamber 11 is disposed higher in the gravity direction (vertical direction) than an opening 211 for communication between the other end portion of the first branch channel 210 and the ink storage chamber 11. The second branch channel 220 communicates with the merging channel 200 at an opening 222 and the first branch channel 210 communicates with the merging channel 200 at an opening 212. The communicating channel 22 of the present embodiment is formed by sealing with the flexible member one open side having a substantially groove shape, integrally formed with the first housing member 40, but a method for forming a channel is not limited to the present embodiment.

In the present embodiment, both of the first branch channel 210 and the second branch channel 220 have the same cross sectional shape and the same cross-sectional area as the merging channel 200. Furthermore, an angle $\alpha$ defined by a center axis of the first branch channel 210 and a center axis of the merging channel 200 is designed to be larger than an angle $\beta$ defined by a center axis of the second branch channel 220 and the center axis of the merging channel 200. In the present embodiment, the angle $\alpha$ is set to about 180 degrees and the angle $\beta$ is set to about 90 degrees. However, the angles $\alpha$ and $\beta$ are not limited to the angles of the present embodiment, and may be set within a range between ±90 degrees and $\alpha>\beta$. The angle $\alpha$ is preferably within a range of 170 to 190 degrees, and is particularly preferably 180 degrees. The angle $\beta$ is preferably within a range of 80 to 100 degrees, and is particularly preferably 90 degrees.

If the ink cartridge 1 having the above configuration is mounted on the subtank 51 of the apparatus body 30, the ink stored in the ink cartridge 1 flows from the first and second branch channels 210 and 220 to the merging channel 200. The ink that has flown into the merging channel 200 flows from the tube insertion port 8 to the ink supply tube 52 disposed in the seal member 19, then flows into the joint chamber 56 of the subtank 51, and is supplied to the print head 32.

Meanwhile, if the ink cartridge 1 is left for a long period of time while being mounted on the subtank 51, or if the ink cartridge 1 is left for a long period of time in the same position before mounted on the subtank 51, a colorant of ink in the ink storage chamber 11 gradually precipitates. In the present embodiment, as pigments are used as the colorant of the ink, pigment particles precipitate in the ink storage chamber 11. Accordingly, in the present embodiment, in the ink in the ink storage chamber 11, a concentration gradient of pigment particles is generated from the bottom toward the top. More specifically, at a lower layer area near a bottom surface 11*a* of the ink storage chamber 11, a high concentration ink layer is formed which has a high concentration of pigment particles (colorant concentration) and is an excessively highly colored layer, whereas at an upper layer area located higher than the lower layer area in the gravity direction, a low concentration ink layer is formed which has a low concentration of pigment particles and is an excessively lightly colored layer.

In the present embodiment, since the first branch channel 210 communicates with the ink storage chamber 11 at the opening 211 located near the bottom surface 11*a* of the ink storage chamber 11, the first branch channel 210 communicates with the lower layer area in which a high concentration ink having a high concentration of pigment particles is present. Furthermore, since the second branch channel 220 communicates with the ink storage chamber 11 at the opening 221 located higher than the opening 211, the second branch channel 220 communicates with the upper layer area in which a low concentration ink having a lower concentration of pigment particles is present. Accordingly, the low concentration ink and the high concentration ink flow into the merging channel 200 from the second branch channel 220 and the first branch channel 210, respectively. Note that a ratio between a flow rate of the ink flowing from the first branch channel 210 to the merging channel 200 and a flow rate of the ink flowing from the second branch channel 220 to the merging channel 200 is in accordance with a ratio between a flow resistance of the first branch channel 210 and a flow resistance of the second branch channel 220. After that, the ink that has passed through the merging channel 200 flows into the joint chamber 56 of the subtank 51 via the ink supply tube 52 and is supplied to the print head 32 via the ink channel 61.

In the present embodiment, the low concentration ink and the high concentration ink in the ink storage chamber 11 flow into the merging channel 200 at a predetermined flow rate ratio, and then mixed through a process before the ink is supplied to the print head 32. Therefore, even if the ink cartridge 1 is left for a long period of time in a fixed position, ink having a predetermined concentration of pigment particles may be stably supplied at the time of use.

2-5. Stirring Ink in Ink Cartridge

Next, a description will be given of a stirring operation of ink in the ink cartridge 1 performed by the ink jet printing apparatus 100 of the present embodiment on which the above ink cartridge 1 is mounted. As described earlier, if the ink cartridge 1 is left for a long period of time in a fixed position, a colorant (pigment particles in the case of pigment-based ink) of the ink precipitates and a concentration gradient of the colorant is generated in the ink. At the same time, if the precipitated colorant easily flows, as described above, merging the ink captured from the first and second branch channels 210 and 220 can supply ink having a stable concentration to the print head 32. However, if the ink cartridge 1 is left for a long period of time in a fixed position, the colorant may settle at the bottom surface 11*a* of the ink storage chamber 11, and the concentration may affect print quality.

In the present embodiment, therefore, if the ink cartridge 1 mounted on the subtank 51 is under predetermined conditions of use, for example, if the ink cartridge 1 is left for a long period of time, a backflow stirring operation is performed in which the ink is caused to flow backward from the apparatus body 30 to the ink storage chamber 11 and the ink in the ink storage chamber 11 is stirred. The backflow stirring operation will now be described with reference to FIGS. 1, 6, and 9 to 11.

The backflow stirring operation performed in the present embodiment uses a decompression unit for changing a pressure in the decompression chamber 62 formed in the cartridge mounting unit 50 and causing the elastic portion 70*a* of the elastic member 70 to be deformed/reversed. As shown in FIG. 10B, the decompression unit includes the suction pad 320 provided on a side surface of a feeding device 330, a tube 310 connected to the suction pad 320, and a pump unit 300 connected to the tube 310.

Here, a detailed description will be given of the backflow stirring operation in the present embodiment performed by using the decompression unit. FIG. 9 is a longitudinal sectional view (cross section taken along line IX-IX of FIG. 8) showing a state of the elastic member 70 before and after the backflow stirring operation (initial state). FIG. 10A is a partial longitudinal sectional view (cross section taken along line Xa-Xa of FIG. 8) of FIG. 8. FIG. 10B is a partially enlarged view of FIG. 9. FIG. 11 is a longitudinal sectional view showing a state of the elastic member 70 (reversed state) during the backflow stirring operation.

In a case where the backflow stirring operation is performed, first, the head unit 38 as well as the carriage 31 is moved in a main scanning direction (X direction) to bring the suction pad 320 in contact with a portion around a decompression port 64 as shown in FIG. 10B. This allows the portion around the decompression port 64 and the suction pad 320 to be hermetically kept in contact with each other, and also the pump unit 300 and the decompression channel 63 to be connected via the suction pad 320 and the tube 310. After the connection, the decompression chamber 62 is decompressed by the pump unit 300, so that the elastic portion 70*a* of the elastic member is pulled toward the decompression chamber 62 and the elastic portion 70*a* is reversed downwardly. As a result, the volume of the decompression chamber 62 rapidly changes, and the ink in a volume corresponding to the change is introduced from the ink cartridge 1 to the joint chamber 56. After that, if the pump unit 300 is released to the air, the elastic portion 70*a* that is reversed downwardly returns to an initial state (to a state in which the elastic portion 70*a* protrudes upwardly) by an elastic recovery force of the elastic member 70. Accordingly, the volumes of the ink chamber 57 and the joint chamber 56 rapidly change (decrease), and the ink in a volume corresponding to the change returns to the ink cartridge 1 via the ink supply tube 52.

FIG. 6B shows a state in which the ink that has returned to the ink cartridge 1 flows into the ink storage chamber 11 at the time of the backflow stirring operation. As shown in FIG. 6B, the ink flowing backward from the ink supply tube 52 passes through the merging channel 200 and then flows into the first branch channel 210 via the opening 212 and also flows into the second branch channel 220 via the opening 222. As described earlier, in the present embodiment, the angle between the center axis of the first branch channel 210 and the center axis of the merging channel 200 is set to about 180 degrees, and a channel formed by the merging channel 200 and the first branch channel 210 is continuous and substantially straight. Therefore, a flow resistance at the time when the ink flows from the merging channel 200 to the first branch channel 210 is relatively small, and the ink smoothly passes through the first branch channel and flows into the lower layer area of the ink storage chamber.

On the other hand, the angle between the center axis of the merging channel 200 and the center axis of the second branch channel 220 is set to about 90 degrees as described earlier. More specifically, a channel formed by the merging channel 200 and the second branch channel 220 is curved. Therefore, the ink which has passed through the merging channel 200 easily flows into the first branch channel 210 arranged on the same straight line as the merging channel 200, but does not easily flows into the second branch channel 220 arranged in a vertical direction with respect to the merging channel 200. Accordingly, a ratio (Q1/Q2) between an ink flow rate (Q1) in the first branch channel 210 and an ink flow rate (Q2) in the second branch channel 220 while ink is supplied is different from that while ink flows backward. More specifically, the ratio (Q1/Q2) while ink is supplied is designed to be smaller than the ratio (Q1/Q2) while ink flows backward. Therefore, a colorant such as pigment particles present in the lower layer area can be effectively stirred. This allows the backflow stirring operation to be completed in a short period of time and reduces a standby time of printing operation. Both ink flow rates represented by Q1 and Q2 indicate a flow rate per the same time (unit time). In the present embodiment, more pigment particles in the ink layer having a high concentration can be mixed up by one backflow stirring operation to decrease a concentration of pigments of ink present in the lower layer area, and accordingly a print standby time can be minimized.

Next, a description will be given of a method for determining whether a backflow stirring operation is required and the number of backflow stirring operations. Whether a backflow stirring operation is required and the number of backflow stirring operations are determined by the control unit 35 based on the information stored in the memory element 5 of the ink cartridge 1. Examples of the information stored in the memory element 5 include a production data of a cartridge, a type of ink, the last date on which the backflow stirring operation was performed, an amount of ink filled into the ink storage chamber, and a remaining amount of ink. Whether a backflow stirring operation is required and the number of backflow stirring operations are determined based on one or more pieces of information of the above-mentioned information. For example, if a new ink cartridge 1 is mounted on the subtank 51, the required number of backflow stirring operations is determined based on an elapsed time from the production date, a type of ink, an amount of ink filled into the ink storage chamber 11, an ink filling time (for example, year, month, and day), and the like. As an elapsed time from the production date is longer; the amount of ink filled into the ink storage chamber 11 is greater; and the colorant of the ink precipitates more easily, the number of backflow stirring operations is increased. In a case where the ink cartridge 1 is unused, however, its storage position and storage environment such as temperature or humidity are unclear. Accordingly, in a case where a combination of a type of ink, an ink flow rate, or the like of the unused ink cartridge 1 is a combination that may generate a steep concentration gradient of ink, it is preferable to set the number of backflow stirring operations such that ink can be sufficiently stirred irrespective of an elapsed time.

Furthermore, in a case where the ink cartridge 1 is in the middle of use, the number of backflow stirring operations is determined based on an elapsed time from the last date on which the backflow stirring operation was performed, a type of ink, and a remaining amount of ink. The number of stirring operations is increased as an elapsed time is longer; the remaining amount of ink is greater; and the colorant of the ink precipitates more easily.

As described above, conditions for execution of the backflow stirring operation are determined based on the information stored in the memory element 5, so that a minimum number of stirring operations is set, and a print standby time due to the stirring operation can be reduced. Furthermore, in the present embodiment, as shown in FIG. 10A, four decompression chambers 62 provided in a manner corresponding to four ink cartridges are merged into one decompression channel 63 to simultaneously decompress the four decompression chambers 62. More specifically, one decompression port 64 communicating with one decompression channel 63 is provided on the side wall of the cartridge mounting unit 50 to simultaneously decompress the four decompression chambers 62 by using one decompression unit including one suction pad 320. This can simplify the decompression unit and reduce cost. Furthermore, in the configuration in which a plurality of (four) ink cartridges in the ink cartridges 1 are subjected to backflow stirring through the same process as in the present embodiment, to maintain ink in all of the ink cartridges in a favorable condition, it is preferable to perform stirring operations in accordance with the ink cartridge which requires the largest number of stirring operations.

Second Embodiment

Next, a description will be given of a second embodiment of the present invention with reference to FIGS. 12 and 13. In the second embodiment, a first branch channel communicating with an upper layer area of an ink storage chamber 11 and a second branch channel communicating with a lower layer area of the ink storage chamber 11 are configured as follows. It should be noted that other configurations are the same as those in the first embodiment, and the same reference signs are used in FIG. 12 for the same or corresponding reference signs used in the above embodiment.

Figure 12:
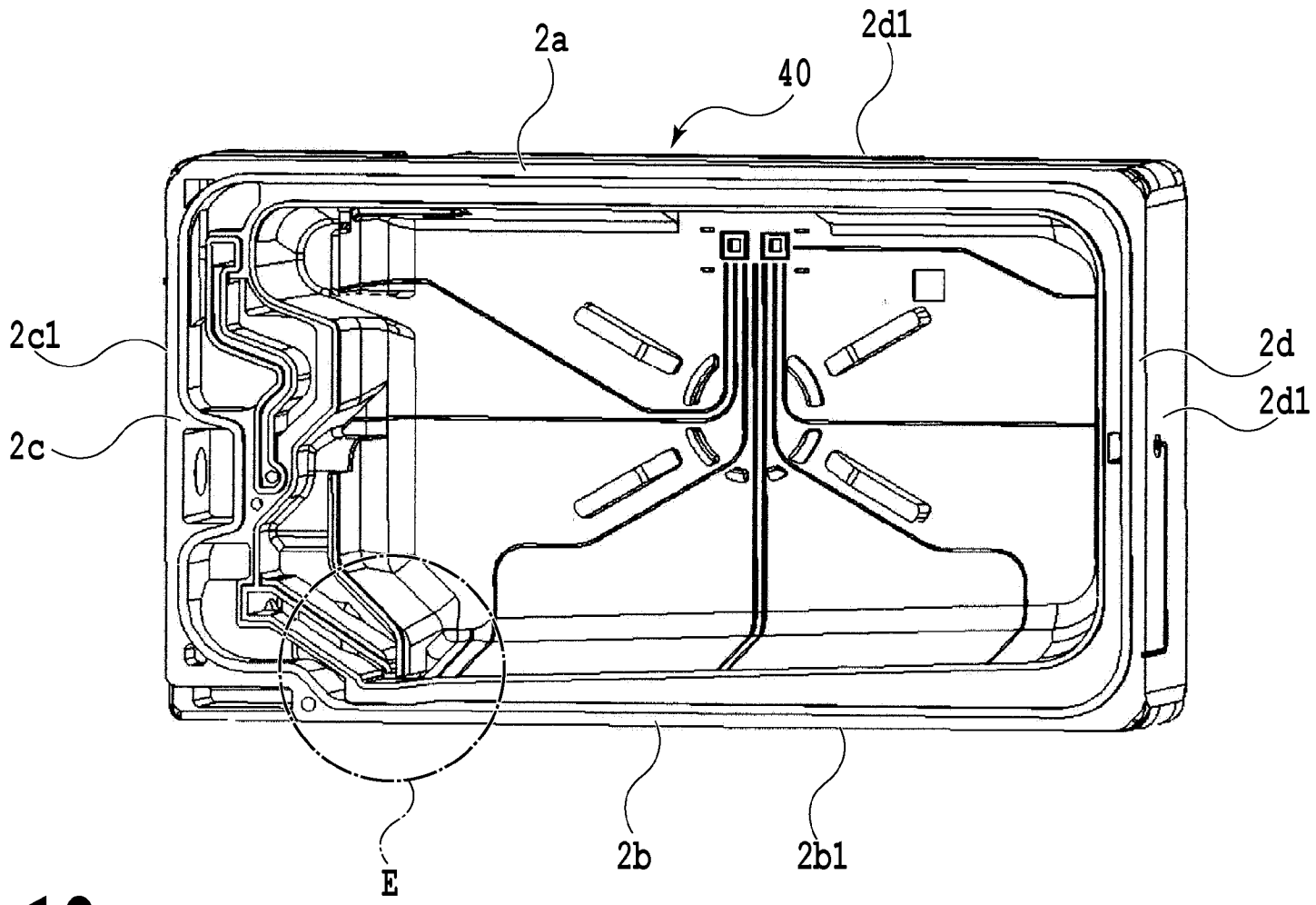
FIG. 12 is a plan view showing an internal configuration of a housing of a cartridge mounting unit according to a second embodiment.
Figure 13:
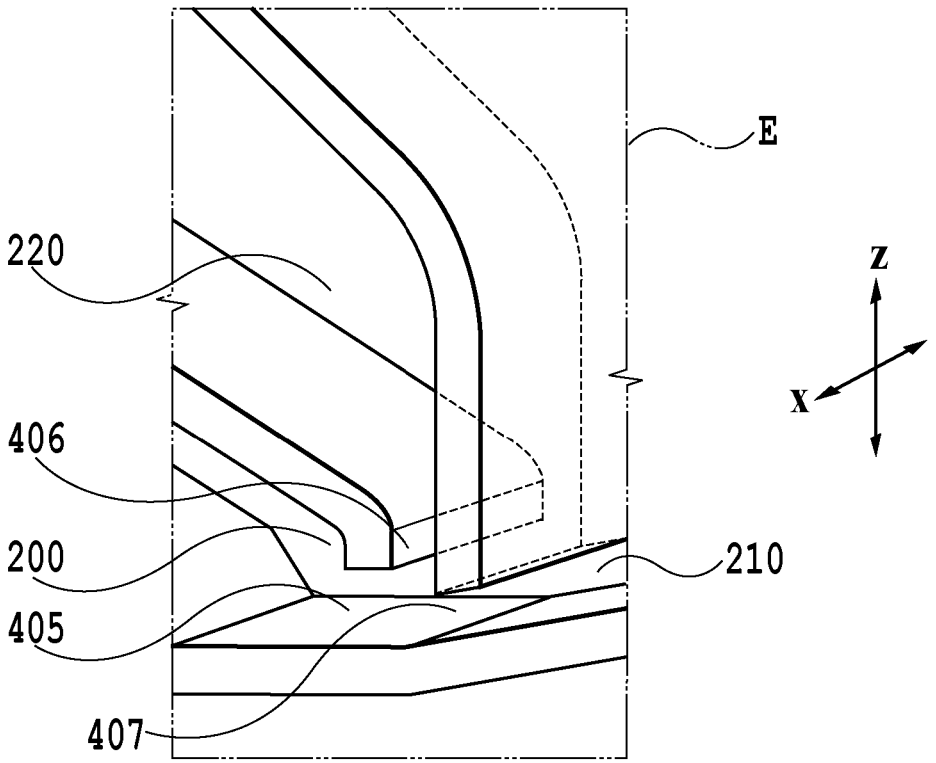
FIG. 13 is an enlarged perspective view of portion E shown in FIG. 12.

FIG. 12 is a perspective view showing an internal structure of a first housing member 40 of a housing 2 according to the second embodiment. FIG. 13 is an enlarged perspective view of portion E shown in FIG. 12 and mainly shows a merging channel 200, a first branch channel 210, a second branch channel 220, and the like of the housing. In the second embodiment, a branch port 405 is formed at an end of the merging channel 200 which communicates with the first and second branch channels 210 and 220. The branch port 405 branches into a lower extraction port 407 communicating with the first branch channel 210 and an upper extraction port 406. The lower extraction port 407 is formed in a slit shape and its width in a direction (X direction) perpendicular to its gravity direction (vertical direction) is greater than the width in the gravity direction (Z direction). Since an ink chamber has a width in the X direction, a precipitated ink colorant (pigment particles) is also distributed across the width direction of a bottom surface 11*a* of the ink storage chamber 11. Accordingly, in specifying a predetermined cross-sectional area of a channel, as in the present embodiment, the lower extraction port 407 is designed to have a greater width in the X direction of the ink storage chamber 11 so that ink flows widely in the width direction of the bottom surface 11*a* of the ink storage chamber 11. This allows the ink settled in the bottom surface 11*a* of the ink storage chamber 11 to be efficiently stirred. Furthermore, it is also preferable to set the width in the X direction of the upper extraction port 406 and the branch port 405 to be equal to the width of the lower extraction port 407.

Other Embodiments

In the above embodiments, a plurality of (four) ink cartridges are configured to be decompressed simultaneously by one decompression unit, but the present invention should not be limited to this configuration. For example, a plurality of decompression units may be provided independently in a manner corresponding to the plurality of ink cartridges, and a backflow stirring operation may be individually performed for each ink cartridge.

Alternatively, the plurality of ink cartridges may be segmented into a plurality of groups and the backflow stirring operation may be individually performed for each group. In this case, a plurality of decompression units may be prepared in a manner corresponding to the plurality of groups, or a switching unit, such as a valve, may be used to switch communication between a single decompression unit and each group.

In the above embodiments, a ratio between an ink flow rate in the first branch channel and an ink flow rate in the second branch channel is set such that an arrangement (angle) of each branch channel with respect to the merging channel while ink flows backward is smaller than that while ink is supplied. However, the present invention should not be limited to this, and same function may be achieved by other configurations. For example, a oneway valve that can be open or closed may be provided between the second branch channel and the merging channel, and the valve is open to allow the ink to be supplied to the merging channel while the ink is supplied, and the valve is closed to allow the ink flowing from the merging channel into the second branch channel to be partly or entirely blocked during the backflow stirring operation. Accordingly, a ratio (Q1/Q2) between an ink flow rate (Q1) in the first branch channel and an ink flow rate (Q2) in the second branch channel while ink is supplied may be designed to be smaller than the ratio (Q1/Q2) while the ink flows backward and is stirred. In particular, entirely blocking the ink flowing into the second branch channel by way of the valve during the backflow stirring operation causes all of the ink from the merging channel to flow into the first branch channel, and the stirring operation for the lower layer area of the ink cartridge can be performed more intensely.

In the above embodiments, a single channel is provided for each of the first branch channel and the second branch channel with respect to the merging channel of each ink cartridge, but a plurality of channels may be provided for one or both of the first and second branch channels.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2014-132857, filed Jun. 27, 2014, No. 2015-063169, filed Mar. 25, 2015, and No. 2015-108880, filed May 28, 2015, which are hereby incorporated by reference wherein in their entirety.

What is claimed is:

1. An ink cartridge comprising:

a housing in which an ink storage chamber for storing ink is formed; and a communication unit configured to allow the ink storage chamber to communicate with a space outside the housing, wherein the communication unit includes a communication port formed on an outside surface of the housing, a merging channel having an end which communicates with the communication port, and a branch channel having an end which communicates with the merging channel and the other end which communicates with the ink storage chamber, wherein the branch channel includes at least one first branch channel communicating with a lower layer area in the ink storage chamber and at least one second branch channel communicating with an upper layer area located higher than the lower layer area in a gravity direction, wherein while ink is supplied to flow from the ink storage chamber to the outside, the ink flowing from the first branch channel and the second branch channel merges into the merging channel, and wherein in a case where an ink flow rate in the first branch channel is represented by Q1 and an ink flow rate in the second branch channel is represented by Q2, a ratio (Q1/Q2) between the ink flow rate in the first branch channel and the ink flow rate in the second branch channel while the ink is supplied is smaller than that while the ink flows backward to flow from the outside to the ink storage chamber.

2. The ink cartridge according to claim 1, wherein the lower layer area in the ink storage chamber includes ink having a higher concentration of a colorant than that of ink in the upper layer area due to precipitation of the colorant in the ink.

3. The ink cartridge according to claim 1, wherein while the ink is supplied, after flowing into the merging channel, a high concentration ink flowing from the lower layer area to the first branch channel and a low concentration ink flowing from the upper layer area to the second branch channel are supplied from the communication port to the outside of the housing.

4. The ink cartridge according to claim 1, wherein an angle defined by a center axis of the merging channel and a center axis of the first branch channel is greater than an angle defined by the center axis of the merging channel and a center axis of the second branch channel.

5. The ink cartridge according to claim 4, wherein an angle defined by the center axis of the merging channel and the center axis of the first branch channel is within a range of 170 degrees to 190 degrees.

6. The ink cartridge according to claim 5, wherein an angle defined by the center axis of the merging channel and the center axis of the second branch channel is within a range of 80 degrees to 100 degrees.

7. The ink cartridge according to claim 1, wherein the housing has a decompression port that can be connected to a decompression unit for decompressing the ink storage chamber.

8. The ink cartridge according to claim 1, wherein the communication port can be connected to an ink delivery unit for supplying ink to a print head that can eject ink.

9. The ink cartridge according to claim 1, wherein a channel communicating with the lower layer area is configured such that a width in a direction perpendicular to a gravity direction is greater than a width in the gravity direction.

10. An ink jet printing apparatus for supplying ink from an ink delivery unit to a print head and performing printing on a print medium by ejecting ink from the print head, the ink delivery unit comprising:

an ink cartridge for storing ink to be supplied to a print head;

an ink delivery unit capable of delivering ink between the ink cartridge and the print head; and an ink backflow unit configured to cause ink to flow backward from the ink delivery unit to the ink cartridge, the ink cartridge comprising:

a housing in which an ink storage chamber for storing ink is formed; and a communication unit for allowing the ink delivery unit to communicate with the ink storage chamber, the communication unit including a communication port formed on an outside surface of the housing, a merging channel having an end which communicates with the communication port, and branch channels, each having an end which communicates with the merging channel and the other end which communicates with the ink storage chamber, wherein each of the branch channels includes at least one first branch channel communicating with a lower layer area in the ink storage chamber and at least one second branch channel communicating with an upper layer area located higher than the lower layer area in a gravity direction in the ink storage chamber, wherein while ink is supplied to flow from the ink storage chamber to the outside, the ink flowing from the first branch channel and the second branch channel merges into the merging channel, and wherein in a case where an ink flow rate in the first branch channel is represented by Q1 and an ink flow rate in the second branch channel is represented by Q2, a ratio (Q1/Q2) between the ink flow rate in the first branch channel and the ink flow rate in the second branch channel while the ink is supplied is smaller than that while the ink flows backward to flow from the outside to the ink storage chamber.

11. The ink jet printing apparatus according to claim 10, wherein the ink backflow unit increases a pressure in the ink delivery unit to be higher than a pressure in the ink storage chamber, so that ink flows backward from the ink delivery unit to the ink storage chamber.

12. The ink jet printing apparatus according to claim 10, wherein the ink cartridge has a storage unit configured to store information for determining an operation of the ink backflow unit.

13. The ink jet printing apparatus according to claim 12, wherein the ink backflow unit determines an operation of the ink backflow unit based on at least one piece of information stored in the storage unit, the information including an ink filling time, a type of ink, a last date on which ink backflow was performed, an amount of ink filled, and a remaining amount of ink.

14. The ink jet printing apparatus according to claim 10, wherein the ink delivery unit includes a plurality of the ink cartridges, and the ink backflow unit causes ink to flow backward from the ink delivery unit to the ink storage chamber with respect to all of the plurality of ink cartridges through the same process.

15. The ink jet printing apparatus according to claim 14, wherein in a case where there is at least one ink cartridge requiring backflow of ink among the plurality of ink cartridges, the ink backflow unit causes the ink to flow backward with respect to all of the plurality of ink cartridges.

* * * * *